US009186570B1

(12) United States Patent
Wells

(10) Patent No.: US 9,186,570 B1
(45) Date of Patent: Nov. 17, 2015

(54) SKATEBOARD

(71) Applicant: Dennis Wells, Ridge Manor, FL (US)

(72) Inventor: Dennis Wells, Ridge Manor, FL (US)

( * ) Notice: Subject to any disclaimer, the term of this patent is extended or adjusted under 35 U.S.C. 154(b) by 0 days.

(21) Appl. No.: 14/462,295

(22) Filed: Aug. 18, 2014

Related U.S. Application Data

(60) Provisional application No. 61/959,493, filed on Aug. 26, 2013.

(51) Int. Cl.
*A63C 17/02* (2006.01)
*A63C 17/01* (2006.01)

(52) U.S. Cl.
CPC ..... *A63C 17/012* (2013.01); *A63C 17/015* (2013.01)

(58) Field of Classification Search
CPC ..... A63C 17/011; A63C 17/015
USPC ..... 280/87.042
See application file for complete search history.

(56) References Cited

U.S. PATENT DOCUMENTS 4,886,298 A * 12/1989 Shols ..... 280/842
5,062,630 A * 11/1991 Nelson ..... 482/34
5,347,681 A * 9/1994 Wattron et al. ..... 16/30
6,059,303 A * 5/2000 Bradfield ..... 280/87.042
6,158,752 A * 12/2000 Kay ..... 280/87.042
6,193,249 B1 * 2/2001 Buscaglia ..... 280/87.042
6,206,389 B1 * 3/2001 Yagi ..... 280/87.042
7,178,813 B1 * 2/2007 Bruntmyer ..... 280/87.041
7,325,819 B2 2/2008 Kwak
7,600,768 B2 10/2009 Chen
8,118,319 B2 * 2/2012 Hsieh ..... 280/87.042
8,459,669 B2 * 6/2013 Lin ..... 280/87.042
8,708,354 B2 4/2014 Young
8,720,916 B2 5/2014 Bermal
2007/0278758 A1 * 12/2007 Kwak ..... 280/87.042
2008/0029985 A1 * 2/2008 Chen ..... 280/87.042
2008/0157495 A1 * 7/2008 Choi ..... 280/87.042
2008/0191438 A1 * 8/2008 Piaceski et al. ..... 280/87.042
2009/0045598 A1 * 2/2009 Lee ..... 280/87.042
2009/0200764 A1 * 8/2009 Jang et al. ..... 280/87.042
2010/0117317 A1 * 5/2010 Smith ..... 280/87.042
2012/0086181 A1 * 4/2012 Kinnaman ..... 280/87.042
2012/0161409 A1 * 6/2012 Young ..... 280/87.042
2013/0001910 A1 * 1/2013 Hsu et al. ..... 280/87.042
2014/0210175 A1 * 7/2014 Hsu ..... 280/87.042

* cited by examiner

*Primary Examiner* — Jeffrey J Restifo
(74) *Attorney, Agent, or Firm* — Edward P Dutkiewicz

(57) ABSTRACT

A skateboard, comprising a platform, a rear truck coupled to the platform, and a pair of front casters being coupled to the platform. The skateboard front casters are frictionally coupled with an elastomeric band, thereby frictionally keeping the front casters in alignment.

8 Claims, 2 Drawing Sheets

SKATEBOARD

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

PRIORITY CLAIMED

This application is a continuation in part of a previously filed provisional patent application, bearing Ser. No. 61/959,493, and presently pending. The Applicant claims the priority of the above described provisional application.

BACKGROUND OF THE INVENTION

1. Field of the Invention

The present invention relates to a Skateboard and more particularly pertains to a skateboard having a pair of front casters and a coupling band.

2. Description of the Prior Art

The use of skateboards is known in the prior art. More specifically, skateboards previously devised and utilized for the purpose of allowing a user to ride and maneuver a skateboard are known to consist basically of familiar, expected, and obvious structural configurations, notwithstanding the designs encompassed by the prior art which has been developed for the fulfillment of stated objectives and requirements.

While the prior art devices fulfill their respective, particular objectives and requirements, the prior art does not describe Skateboard that provides a skateboard having a pair of front casters and a coupling band.

In this respect, the Skateboard according to the present invention substantially departs from the conventional concepts and designs of the prior art, and in doing so provides an apparatus primarily developed for the purpose of providing a skateboard having a pair of front casters and a coupling band.

Therefore, it can be appreciated that there exists a continuing need for a new and improved Skateboard which has a pair of front casters and a coupling band. In this regard, the present invention substantially fulfills this need.

SUMMARY OF THE INVENTION

In view of the foregoing disadvantages inherent in the known types of skateboards now present in the prior art, the present invention provides an improved Skateboard. As such, the general purpose of the present invention, which will be described subsequently in greater detail, is to provide a new and improved Skateboard which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain the purpose of the invention, the present invention essentially comprises a skateboard, comprising several components, in combination.

There is a platform. The platform is fabricated of a rigid material. The platform has an upper surface, a lower surface, a forward portion with a forward end, and a rearward portion with a rearward end. There is a length between the forward end and the rearward end. The platform has a thickness between the upper surface and the lower surface. The thickness forms a peripheral edge.

The forward portion of the platform has two pairs of front caster mounting holes there through. The rearward portion of the platform has a plurality of rear truck mounting holes there through. The plurality of rear truck mounting holes are oriented in two parallel linear configurations.

There is a rear truck. The rear truck has a central axle and a pair of wheels. Each of the rear truck wheels have at least one associated bearing to provide smooth rotation of each of the rear truck wheels on the rear truck central axle.

The rear truck central axle has a right side and a left side. The rear truck central axle has a centrally located extension. The centrally located extension of the rear truck central axle has a mounting plate coupled thereto. The rear truck central axle mounting plate has a generally rectilinear configuration with a plurality of bolt holes there through. The bolt holes of the rear truck central axle mounting plate are oriented in two parallel linear configurations so as to match with some of the parallel configurations of the rear truck mounting holes of the platform.

There is a rear truck spacer. The rear truck spacer is fabricated of rigid material. The rear truck spacer has a generally rectilinear configuration, with an upper surface, a lower surface, a front surface, a rear surface, and a pair of parallel side surfaces. The rear truck spacer has a length, a width, and a thickness. The rear truck spacer has a plurality of bolt holes which are oriented to match and align with some of the rear truck mounting holes of the platform, and the rear truck central axle mounting plate bolt holes. The rear truck spacer is directly coupled to the platform. The rear truck is directly coupled to the rear truck spacer.

There is a plurality of rear truck mounting bolts.

There is pair of front casters. Each of the front casters has a mounting plate, a wheel fork, and a wheel. Each of the front caster wheels has at least one associated bearing. The mounting plate of each of the front casters has a generally rectilinear configuration, with each of the front caster mounting plates having a plurality of mounting holes there through. The plurality of mounting holes for each of the front casters are configured to align with each of the pairs of the front caster mounting holes of the front end of the platform. The mounting plate of each of the front casters has a ramped fork mount section.

The wheel fork of each of the front casters has at least one associated bearing. The wheel fork bearing provides for smooth rotation of the each of the wheel forks relative to each of the front caster mounting plates. Each of the wheel forks has a generally circular peripheral skirt. The skirt of each front cater wheel fork has an outer portion, a front portion, a rear portion and an inner portion. The skirt of each of the front caster wheel forks has an outer surface which is continuous.

The wheel forks are oriented at an angle of between about fifteen degrees and seventy degrees relative to the mounting plates of each of the front casters.

There is a plurality of front caster mounting bolts.

There is a front caster coupler. The front caster coupler is fabricated of an elastomeric material. The front caster coupler has a band shaped configuration with an inner surface and an outer surface, with a thickness there between. The front caster coupler has an upper edge and a lower edge, with a width there between. The front caster coupler is stretchably mounted to the outside of each of the caster skirts thereby frictionally maintaining each of the front casters in alignment.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Skateboard which has all of the advantages of the prior art skateboards and none of the disadvantages.

It is another object of the present invention to provide a new and improved Skateboard which may be easily and efficiently manufactured and marketed.

It is further object of the present invention to provide a new and improved Skateboard which is of durable and reliable constructions.

An even further object of the present invention is to provide a new and improved Skateboard which is susceptible of a low cost of manufacture with regard to both materials and labor, and which accordingly is then susceptible of low prices of sale to the consuming public, thereby making such Skateboard economically available to the buying public.

Even still another object of the present invention is to provide a Skateboard having a pair of front casters and a coupling band.

Lastly, it is an object of the present invention to provide a new and improved skateboard, comprising a platform, a rear truck coupled to the platform, and a pair of front casters being coupled to the platform. The skateboard front casters are frictionally coupled with an elastomeric band, thereby frictionally keeping the front casters in alignment.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
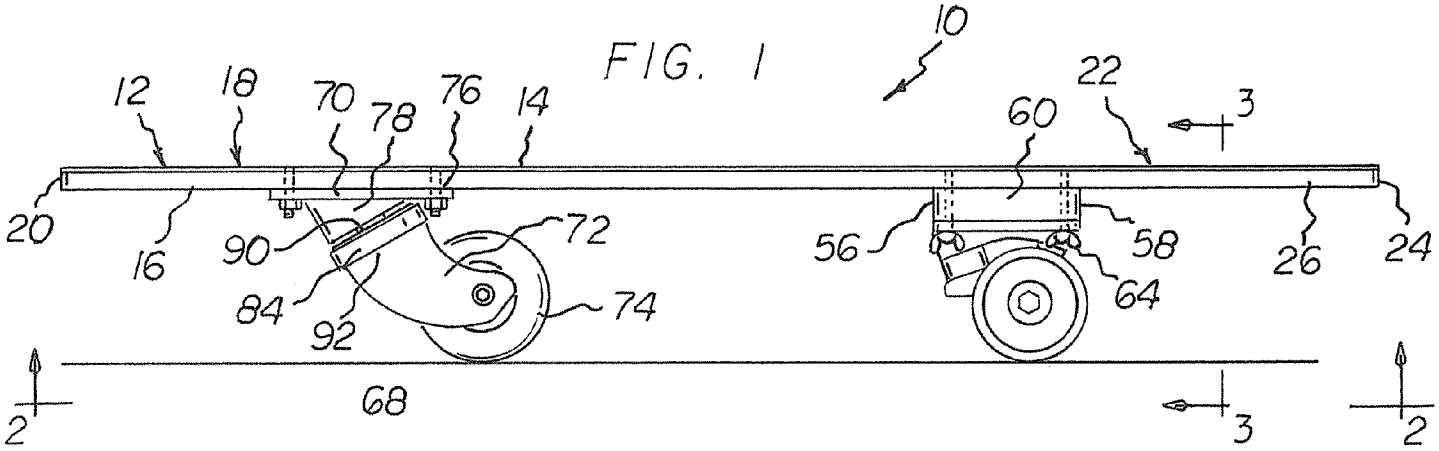
FIG. 1 is side elevational view of the skateboard.
Figure 2:
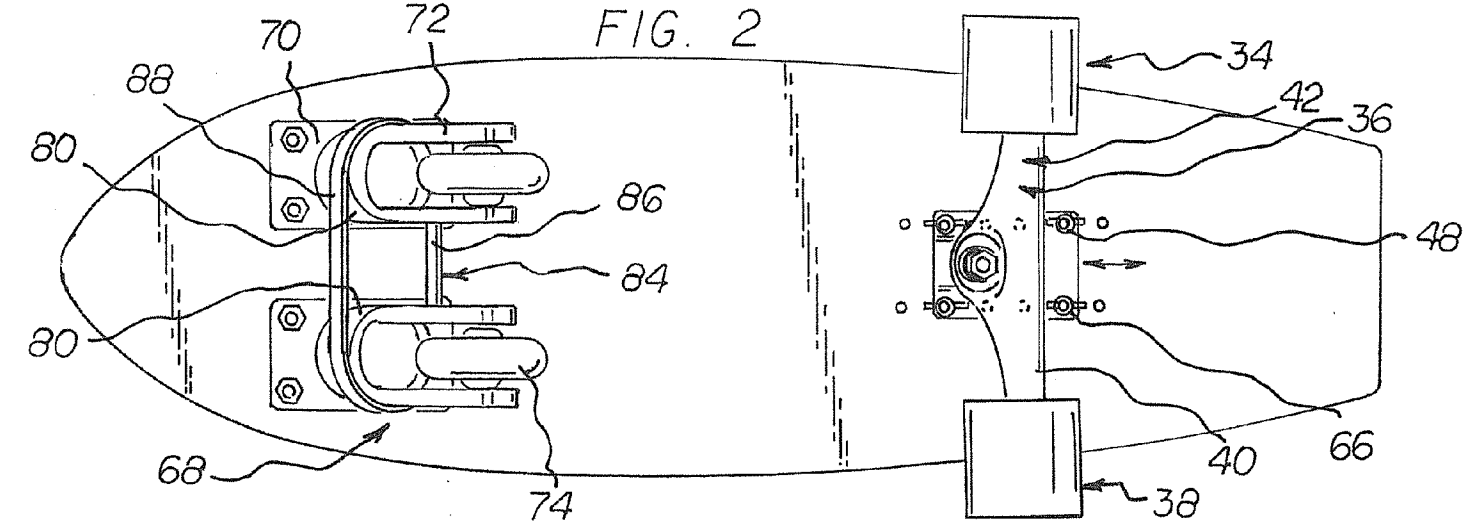
FIG. 2 is a view taken along line 2-2 of FIG. 1.
Figure 3:
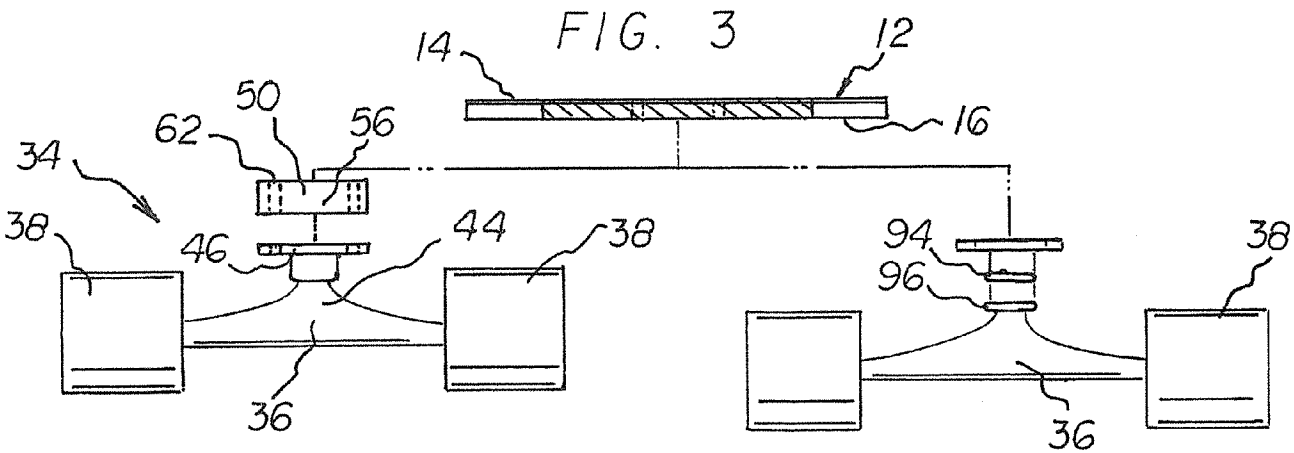
FIG. 3 is a view taken along line 3-3 of FIG. 1.
Figure 4:
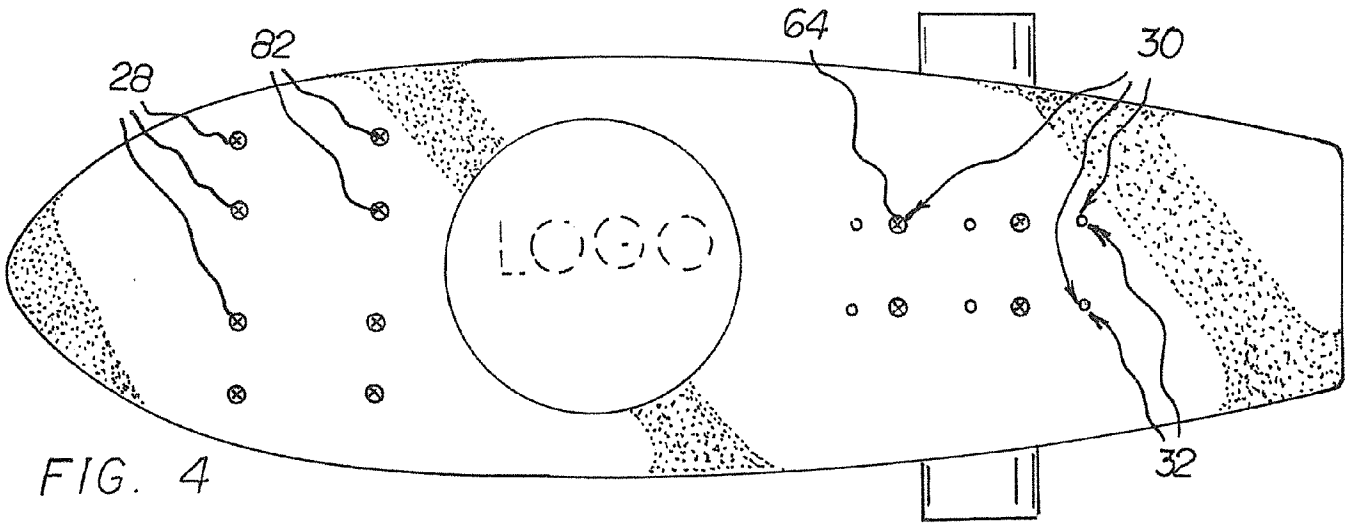
FIG. 4 is a a top plan view of the skateboard. The logo is shown in broken lines. Note the aligned rear truck mounting bolt holes, which allow the rear truck to be located forward or rearward, thereby providing greater maneuverability in the forward location or greater stability in the rearward location. The front caster holes are located in pairs, to mount the front casters to the lower surface of the platform of the skateboard.

With reference now to the drawings, and in particular to FIG. 1 thereof, the preferred embodiment of the new and improved SKATEBOARD embodying the principles and concepts of the present invention and generally designated by the reference numeral 10 will be described.

The present invention, the Skateboard 10 is comprised of a plurality of components. Such components in their broadest context include a platform, a rear truck, a pair of front casters and an elastomeric front caster coupler band. Such components are individually configured and correlated with respect to each other so as to attain the desired objective.

Herein described is a skateboard 10, comprising several components, in combination.

There is a platform 12. The platform is fabricated of a rigid material. The platform has an upper surface 14, a lower surface 16, a forward portion 18 with a forward end 20, and a rearward portion 22 with a rearward end 24. There is a length between the forward end and the rearward end. The platform has a thickness between the upper surface and the lower surface. The thickness forms a peripheral edge 26.

The forward portion of the platform has two pairs of front caster mounting holes 28 there through. The rearward portion of the platform has a plurality of rear truck mounting holes 30 there through. The plurality of rear truck mounting holes are oriented in two parallel linear configurations 32.

There is a rear truck 34. The rear truck has a central axle 36 and a pair of wheels 38. Each of the rear truck wheels have at least one associated bearing to provide smooth rotation of each of the rear truck wheels on the rear truck central axle.

The rear truck central axle has a right side 40 and a left side 42.

The rear truck central axle has a centrally located extension 44. The centrally located extension of the rear truck central axle has a mounting plate 46 coupled thereto. The rear truck central axle mounting plate has a generally rectilinear configuration with a plurality of bolt holes 48 there through. The bolt holes of the rear truck central axle mounting plate are oriented in two parallel linear configurations so as to match with some of the parallel configurations of the rear truck mounting holes of the platform.

There is a rear truck spacer 50. The rear truck spacer is fabricated of rigid material. The rear truck spacer has a generally rectilinear configuration, with an upper surface 52, a lower surface 54, a front surface 56, a rear surface 58, and a pair of parallel side surfaces 60. The rear truck spacer has a length, a width, and a thickness. The rear truck spacer has a plurality of bolt holes 62 which are oriented to match and align with some of the rear truck mounting holes of the platform, and the rear truck central axle mounting plate bolt holes. The rear truck spacer is directly coupled to the platform. The rear truck is directly coupled to the rear truck spacer.

There is a plurality of rear truck mounting bolts 64. The rear truck mounting bolts each have an associated nut 66.

There is pair of front casters 68. Each of the front casters has a mounting plate 70, a wheel fork 72, and a wheel 74. Each of the front caster wheels has at least one associated bearing. The mounting plate of each of the front casters has a generally rectilinear configuration, with each of the front caster mounting plates having a plurality of mounting holes 76 there through. The plurality of mounting holes for each of the front casters are configured to align with each of the pairs of the front caster mounting holes of the front end of the platform. The mounting plate of each of the front casters has a ramped fork mount section 78.

The wheel fork of each of the front casters has at least one associated bearing. The wheel fork bearing provides for smooth rotation of the each of the wheel forks relative to each of the front caster mounting plates. Each of the wheel forks has a generally circular peripheral skirt. The skirt of each front cater wheel fork has an outer portion, a front portion, a rear portion and an inner portion. The skirt of each of the front caster wheel forks has an outer surface 80 which is continuous.

The wheel forks are oriented at an angle of between about fifteen degrees and seventy degrees relative to the mounting plates of each of the front casters.

There is a plurality of front caster mounting bolts 82.

There is a front caster coupler 84. The front caster coupler is fabricated of an elastomeric material. The front caster coupler has a band shaped configuration with an inner surface 86 and an outer surface 88, with a thickness there between. The front caster coupler has an upper edge 90 and a lower edge 92, with a width there between. The front caster coupler is stretchably mounted to the outside of each of the caster skirts thereby frictionally maintaining each of the front casters in alignment.

In a variation, the rear truck has two articulatable couplings, being an upper coupling 94 and a lower coupling 96. The rear truck articulatable couplings allow for flexing of the centrally located axle extension, thereby providing flex below the board. This allows for the user having greater maneuverability of the skateboard.

The skateboard has been used for decades. The present invention has two lines of rearwardly located rear truck mounting holes. This allows the rear truck to be moved, forward or backwards. The forwardmost positioning of the rear truck is referred to as the extreme position, meaning that the user has greater maneuverability of the board. The rearward most positioning of the rear truck provides what is known as a long board, which is less maneuverable, but more stable.

The use of a pair of front casters provides a board which allows a user to propel himself, or herself, up an incline, without pushing the board along with one foot, as is commonly now done. The user "tacks" uphill, without having to touch the ground with his or her foot. Commonly, a user will either push himself uphill with one foot, or get off of the board and walk up hill. The use of a pair of casters allow the user to now "tack" uphill, moving from side to side, propelling the board uphill, without having to push the board, or dismount the board and walk up hill.

The elastomeric coupler keeps the front caster wheels in alignment. When performing maneuvers which lift the front wheels from the ground's surface, the caster wheels may turn in opposite orientations to one another. The band prevents this from readily occurring. Additionally, the band does not fix the wheel positions relative to one another, but, rather, uses friction, which can be overcome. Should a caster wheel get out of alignment when not in contact with the ground, when the wheel does touch the ground's surface, the friction of the band is overcome, and the out of alignment caster wheel is allowed to return to alignment, by overcoming the friction of the elastomeric band. The band is stretched over the caster wheels and the wheel fork skirt. Friction and stretch holds the band in position on the wheel fork skirt. The band contacts the outer surfaces of each of the caster wheel fork skirts.

There is a location on the upper surface of the platform for the application of a logo. This is shown in broken lines.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A skateboard, comprising, in combination:

a platform having an upper surface and a lower surface and a forward portion with a forward end and a rearward portion with a rearward end with a length between, the forward end and the rearward end, the platform having a thickness between the upper surface and the lower surface, the thickness forming a peripheral edge;

a rear truck having a central axle and a pair of wheels, the rear truck central axle having a right side and a left side;

a rear truck spacer having a generally rectilinear configuration with an upper surface and a lower surface and a front and a rear and a pair of parallel side surfaces, the rear truck spacer having a length and a width and a thickness, the rear truck spacer being directly coupled to the rearward portion of the platform and the rear truck being directly coupled to the rear truck spacer;

a pair of front casters being coupled to the forward portion of the platform;

each of the rear truck wheels being smoothly rotatable on the rear truck central axle;

each of the front caster wheel forks having a skirt; and the front caster coupler being stretchably mounted to the outside of each of the caster wheel fork skirts thereby frictionally maintaining each of the front casters in alignment.

2. The skateboard as described in claim 1, with the skateboard further comprising a front caster coupler having an inner surface and an outer surface with a thickness there between, the front caster coupler having an upper edge and a lower edge with a width there between, the front caster coupler being directly joined frictionally coupling the front casters, allowing the front casters to be rotated independently.

3. The skateboard as described in claim 2, with the skateboard further comprising:

the forward portion of the platform having two pairs of front caster mounting holes there through;

each of the front casters having a mounting plate and a wheel fork and a wheel; and the front caster coupler being fabricated of an elastomeric material.

4. The skateboard as described in claim 3, with the skateboard further comprising:

the rearward portion of the platform having a plurality of rear truck mounting holes there through;

a plurality of rear truck mounting bolts;

the mounting plate of each of the front casters having a generally rectilinear configuration with each of the front caster mounting plates having a plurality of mounting holes there through, the plurality of mounting holes for each of the front casters being configured to align with the front caster mounting holes of the front end of the platform, the mounting plate of each of the front casters having a ramped fork mount section; and a plurality of front caster mounting bolts.

5. The skateboard as described in claim 4, with the skateboard further comprising:

the rear truck central axle having a centrally located extension, with the centrally located extension of the rear truck central axle having a mounting plate coupled thereto; and the wheel fork of each of the front casters being rotatable relative to each of the front caster mounting plates.

6. The skateboard as described in claim 5, with the skateboard further comprising:

the plurality of rear truck mounting holes oriented in two parallel configurations, the rear truck central axle mounting plate having a generally rectilinear configuration with a plurality of bolt holes there through; and the skirt of each front cater wheel fork having an outer portion, a front portion, a rear portion and an inner portion, the skirt of each of the front caster wheel forks having an outer surface which is continuous.

7. The skateboard as described in claim 6, with the skateboard further comprising:

the bolt holes of the rear truck central axle mounting plate being oriented in two parallel configurations so as to match with the parallel configurations of the rear truck mounting holes of the platform;

the rear truck spacer having a plurality of bolt holes which are oriented to match and align with the rear truck mounting holes of the platform and the rear truck central axle mounting plate bolt holes; and the wheel forks being oriented at an angle of between about fifteen degrees and seventy degrees relative to the mounting plates of each of the front casters.

8. The skateboard as described in claim 7, with the skateboard further comprising:

the platform being fabricated of a rigid material; and the rear truck spacer fabricated of rigid material.

* * * * *